US008495893B2

(12) United States Patent
Alajimi

(10) Patent No.: US 8,495,893 B2
(45) Date of Patent: Jul. 30, 2013

(54) HYBRID APPARATUS FOR COOLING WATER AND AIR AND HEATING WATER

(76) Inventor: Ali Alajimi, Adan (KW)

( * ) Notice: Subject to any disclaimer, the term of this patent is extended or adjusted under 35 U.S.C. 154(b) by 1107 days.

(21) Appl. No.: 12/350,604

(22) Filed: Jan. 8, 2009

(65) Prior Publication Data

US 2010/0170656 A1 Jul. 8, 2010

(51) Int. Cl.
*F25D 3/00* (2006.01)
*B67D 7/80* (2010.01)

(52) U.S. Cl.
USPC ..... 62/389; 222/146.1; 165/42; 165/43

(58) Field of Classification Search
USPC ..... 62/389; 222/146.1; 165/42, 43, 202, 165/918, 919
See application file for complete search history.

(56) References Cited

U.S. PATENT DOCUMENTS 1,726,093 A * 8/1929 Williams ..... 62/185
2,341,872 A * 2/1944 Kasold ..... 62/238.1
2,495,878 A * 1/1950 Tull ..... 62/339
2,767,960 A * 10/1956 Fast ..... 222/146.1
2,784,879 A * 3/1957 Fischer ..... 222/146.1
2,912,142 A * 11/1959 Schultz ..... 222/547
3,495,612 A * 2/1970 Learn et al. ..... 222/130
3,578,126 A * 5/1971 Adams ..... 222/146.1
3,634,107 A * 1/1972 Cornelius ..... 99/275
3,780,794 A * 12/1973 Staub ..... 165/918
4,007,856 A * 2/1977 Murphy et al. ..... 222/146.1
4,030,634 A * 6/1977 Osborn ..... 222/23
4,034,571 A * 7/1977 Bollinger ..... 62/244
4,142,561 A * 3/1979 Bennett et al. ..... 222/146.1
4,162,029 A * 7/1979 Gottsegen et al. ..... 222/131
4,164,853 A * 8/1979 McDonough ..... 62/389
4,211,342 A * 7/1980 Jamgochian et al. ..... 222/146.1
4,216,879 A * 8/1980 McMillin ..... 222/146.6
4,254,824 A * 3/1981 Springer ..... 312/236
4,350,267 A * 9/1982 Nelson et al. ..... 62/389
4,471,631 A * 9/1984 Anstey et al. ..... 62/389
4,674,296 A * 6/1987 Renaud ..... 62/389
4,730,463 A * 3/1988 Stanfill ..... 222/146.6
4,765,152 A * 8/1988 Armstrong ..... 62/389
4,792,059 A * 12/1988 Kerner et al. ..... 222/146.1
4,823,554 A * 4/1989 Trachtenberg et al. ..... 62/239
4,866,945 A * 9/1989 Bender et al. ..... 222/146.6
4,881,380 A * 11/1989 Mrugala et al. ..... 222/146.1
4,923,091 A * 5/1990 Sutera ..... 222/146.6
4,970,871 A * 11/1990 Rudick ..... 222/146.6
4,996,847 A * 3/1991 Zickler ..... 62/3.64

(Continued)

*Primary Examiner* — Ljiljana Ciric
(74) *Attorney, Agent, or Firm* — Lowe Hauptman Ham & Berner, LLP

(57) ABSTRACT

A hybrid apparatus for cooling water and air while heating water and storing heated water includes a refrigeration system, a first water tank, a water inlet and heat transfer unit for transferring heat from the refrigeration system into a portion of the water from the water inlet. The apparatus also has a conduit for delivering heated water to a first insulated water tank and to a tap for drawing off heated water. In addition, the cooler has a water cooling system and a conduit for cooling a portion of the water from the water inlet and delivering the cooled water to a second water tank. A conduit is also provided for drawing water from the second water tank to a tap of cold water. Further, the cooler includes an air cooler that has a coil and a water pump for pumping cooled water through the coil plus a fan for blowing air across the coil to thereby cool the air.

4 Claims, 3 Drawing Sheets

A schematic sketch for the invented refrigeration system.

U.S. PATENT DOCUMENTS 5,064,097 A * 11/1991 Brog et al. ..... 222/146.1
5,192,004 A * 3/1993 Burrows ..... 222/146.1
5,280,711 A * 1/1994 Motta et al. ..... 62/389
5,329,787 A * 7/1994 Friday ..... 62/389
5,421,159 A * 6/1995 Stokes ..... 62/3.64
5,449,093 A * 9/1995 Burrows ..... 222/146.1
5,495,725 A * 3/1996 Middlemiss ..... 62/389
5,511,388 A * 4/1996 Taylor et al. ..... 62/389
5,540,355 A * 7/1996 Hancock et al. ..... 222/146.6
5,564,289 A * 10/1996 Hino ..... 62/389
5,564,601 A * 10/1996 Cleland et al. ..... 222/146.6
5,582,717 A * 12/1996 Di Santo ..... 222/2
5,597,487 A * 1/1997 Vogel et al. ..... 210/652
5,699,669 A * 12/1997 Gebhard ..... 222/146.6
5,766,453 A * 6/1998 Morellato et al. ..... 222/146.1
5,771,709 A * 6/1998 Smith ..... 62/389
5,772,869 A * 6/1998 Joung ..... 222/146.1
5,819,784 A * 10/1998 Yoon ..... 222/146.1
5,823,007 A * 10/1998 Chang ..... 222/146.1
5,833,096 A * 11/1998 Ohu ..... 222/146.1
5,845,506 A * 12/1998 Jobmann ..... 222/146.6
5,858,437 A * 1/1999 Anson ..... 426/431
5,889,684 A * 3/1999 Ben-David et al. ..... 222/146.1
5,956,965 A * 9/1999 Watanabe et al. ..... 62/389
5,975,365 A * 11/1999 Hsieh ..... 222/146.6
5,976,363 A * 11/1999 Monroe et al. ..... 210/90
6,058,733 A * 5/2000 Morgan ..... 62/389
6,079,221 A * 6/2000 Senner ..... 62/389
6,101,835 A * 8/2000 Butsch et al. ..... 222/146.1
6,143,258 A * 11/2000 Tamura et al. ..... 422/307
6,179,168 B1 * 1/2001 Desrosiers et al. ..... 222/146.1
6,207,046 B1 * 3/2001 Yamashita et al. ..... 222/146.1
6,213,199 B1 * 4/2001 Al-Khateeb ..... 165/48.1
6,264,830 B1 * 7/2001 Plester et al. ..... 210/85
6,389,839 B1 * 5/2002 Sabin ..... 62/389
6,418,742 B1 * 7/2002 Chaney ..... 62/389
6,460,735 B1 * 10/2002 Greenwald et al. ..... 222/146.1
6,463,753 B1 * 10/2002 Haskayne ..... 62/389
6,481,238 B1 * 11/2002 Jennings et al. ..... 62/389
6,616,011 B2 * 9/2003 Derry et al. ..... 222/146.6
6,616,897 B1 * 9/2003 Lurz et al. ..... 62/389
6,619,511 B2 * 9/2003 Hydak et al. ..... 222/146.6
6,626,005 B2 * 9/2003 Schroeder ..... 62/389
6,626,213 B2 * 9/2003 Maritan et al. ..... 222/185.1
6,636,151 B2 * 10/2003 Busick ..... 340/521
6,648,180 B2 * 11/2003 Moon et al. ..... 222/146.1
6,681,594 B1 * 1/2004 Nelson ..... 62/389
6,694,739 B2 * 2/2004 Beckius et al. ..... 60/645
6,805,774 B2 * 10/2004 Dableh ..... 203/1
7,040,110 B2 * 5/2006 Nowak ..... 62/389
7,044,335 B2 * 5/2006 Aguirre et al. ..... 222/146.6
7,080,525 B2 * 7/2006 McCann et al. ..... 62/389
7,117,685 B2 * 10/2006 Wetherbee ..... 222/146.6
7,146,818 B2 * 12/2006 Hawkins, Jr. et al. ..... 62/389
7,150,163 B1 * 12/2006 McAllister ..... 62/389
7,175,054 B2 * 2/2007 Davis et al. ..... 222/146.6
7,182,222 B2 * 2/2007 Prabucki ..... 222/146.1
7,207,189 B2 * 4/2007 An et al. ..... 62/389
7,258,803 B2 * 8/2007 Davis ..... 62/389
7,275,387 B2 * 10/2007 Gist et al. ..... 62/389
7,337,627 B2 * 3/2008 Wolski et al. ..... 222/146.6
7,357,001 B2 * 4/2008 Yoon ..... 62/389
7,401,545 B2 * 7/2008 Hu et al. ..... 99/281
7,490,739 B2 * 2/2009 Prabucki ..... 222/146.6
7,596,306 B2 * 9/2009 Greenway et al. ..... 222/146.2
7,597,215 B2 * 10/2009 Sleiman ..... 222/146.1
7,628,023 B2 * 12/2009 Lucas ..... 62/389
7,631,511 B2 * 12/2009 Al-Azmi et al. ..... 62/389
7,640,766 B2 * 1/2010 Shelton ..... 62/389
7,654,191 B2 * 2/2010 Greenwald et al. ..... 222/146.2
7,661,459 B2 * 2/2010 Wesley et al. ..... 165/919
7,669,738 B1 * 3/2010 Byers ..... 222/164
7,672,576 B2 * 3/2010 Grossbach et al. ..... 392/463
7,681,605 B2 * 3/2010 Emes et al. ..... 141/105
7,721,568 B1 * 5/2010 Grutza, Jr. ..... 62/389
7,748,233 B2 * 7/2010 Davis et al. ..... 62/389
7,861,550 B2 * 1/2011 Knoll et al. ..... 62/389
8,025,185 B1 * 9/2011 Stephans ..... 222/146.1
8,083,104 B2 * 12/2011 Roetker et al. ..... 222/146.1
2005/0139552 A1 * 6/2005 Forsberg et al. ..... 210/748

* cited by examiner

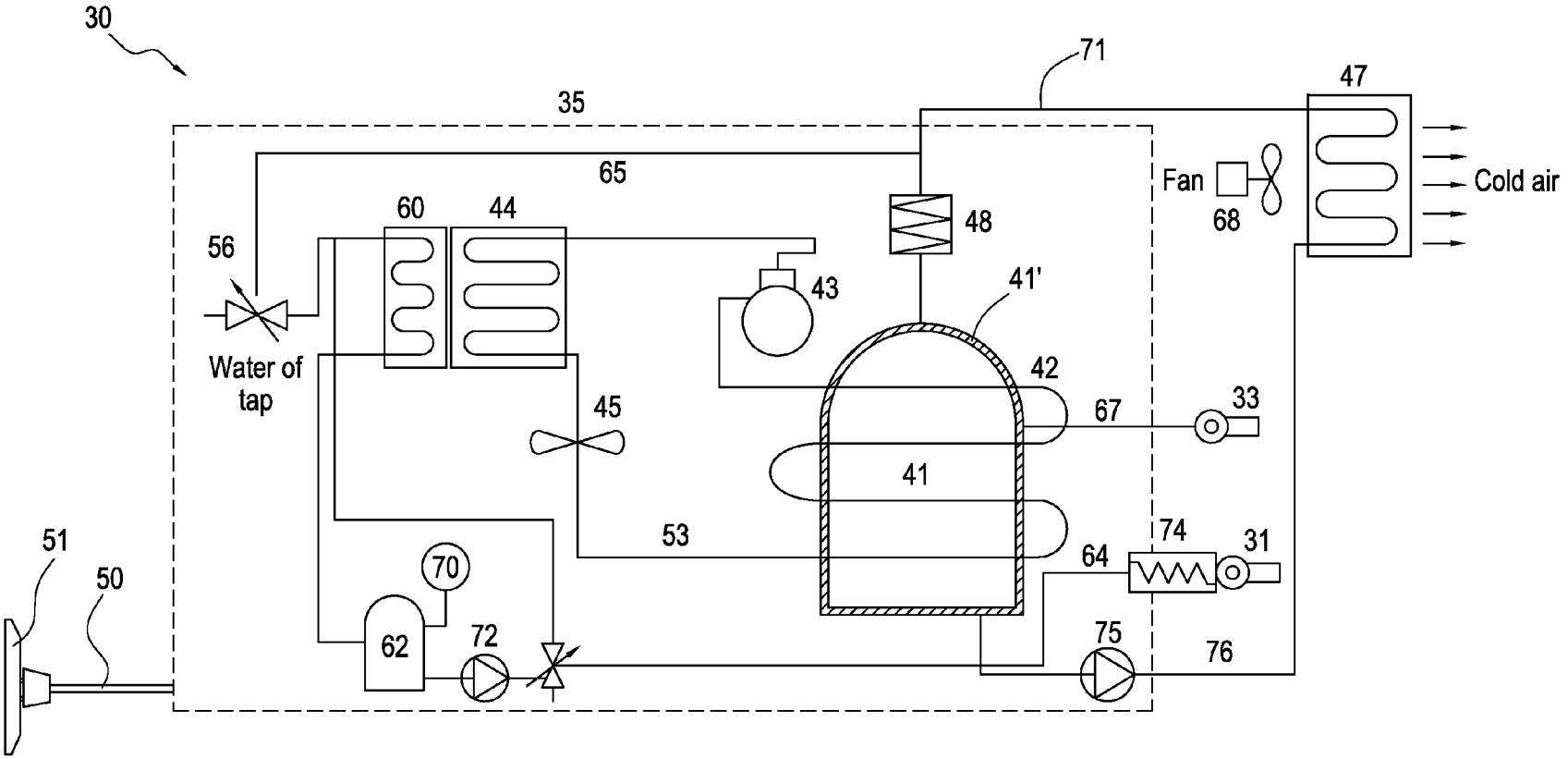
Figure 3: A schematic sketch for the invented refrigeration system.

HYBRID APPARATUS FOR COOLING WATER AND AIR AND HEATING WATER

FIELD OF THE INVENTION

This invention relates to a hybrid apparatus and more particularly to a hybrid apparatus for cooling water and air while heating water and storing heated water.

BACKGROUND FOR THE INVENTION

Bottled drinking water is widely used in offices and homes throughout the world. While many individuals buy small containers of such water as for example ranging from 6 oz. to one or even 2½ gallons. Others prefer to purchase water in 5 gallon bottles. Water in larger bottles is generally less expensive and usually used with a cabinet type dispenser that frees up an individual's refrigerator.

The larger water bottles and dispensers typically in use include a stand or cabinet for holding the water bottle in an inverted position, a reservoir, a faucet and tubing to connect the faucet and reservoir. In practice, the dispensers dispense ambient water for cooking, making coffee and tea and chilled water for drinking. Many dispensers also include a heater and dispense hot water of sufficient temperature to make instant coffee or tea.

Efforts have also been made to reduce the use of energy to heat and cool water. For example, a standard hot and cold bottled water cooler can use more energy than a large refrigerator. It has also been recognized that some products meet the strict energy efficient guidelines set by the U.S. Environmental Protection Agency and Department of Energy. Water coolers that meet these requirements include: Improved separation of hot and cold water to prevent mixing, more insulation to keep heated water hot and chilled water cold and improved chilling mechanisms.

One example of a water cooler and dispenser system is shown in a U.S. Pat. No. 5,540,355 of Hancock et al. As disclosed therein a water cooler and dispensing system includes a housing, a pump, a cap, a siphon tube, a reservoir, a cooling unit, control circuitry and a faucet. The housing includes a frame and detachable panels for supporting the reservoir above a water bottle. The cap substantially seals the bottle and is coupled to the pump. The pump forces air into the bottle and water upward through the siphon tube to the reservoir. A liquid pumping system may also be used. The reservoir is divided into two portions and the lower portion contains a cooling unit for chilling the water. The reservoir has an output port from each portion of the reservoir coupled to a faucet formed by a manifold, two valves and a nozzle. The dispenser also includes control circuitry for selectively operating the pump to maintain a predetermined water level in the reservoir. The controller also lights an indicator when the bottle is empty.

Refrigerators that dispense chilled water are also well known. Refrigerators of this type typically provide chilled tap water. To Applicant's knowledge such refrigerators are not adapted to work with bottled water and do not provide hot water.

Another problem associated with water cooling and dispensing relates to the use of water coolers in a kitchen. The problem is that refrigerators, water coolers that incorporate refrigeration to chill water all produce heat and when added to the heat of cooking contributes to an uncomfortable atmosphere.

It is presently believed that a hybrid apparatus for cooling and heating water in accordance with the present invention will reduce the problem of an additional heat producing refrigeration unit by using the water cooler as an air-conditioner and by utilizing the heat generated by the unit to heat a supply of hot water for future use as for example the hot water used in cooking.

It is also believed that the hybrid apparatus for cooling and heating water in accordance with the present invention are more efficient that conventional coolers. Further, it is believed that the hybrid water system can be manufactured and sold with a relatively small increase in cost, are durable, long lasting and easy to use.

BRIEF SUMMARY OF THE INVENTION

In essence, the present invention contemplates a hybrid apparatus and preferably a portable water cooler and heater that is adapted to be plugged into an electrical wall socket for cooling water and air while heating water and storing heated water. The apparatus includes a refrigeration unit of the type typically incorporated in a conventional water cooler for providing refrigerated water for human consumption. The water cooler also includes a first water tank and a water inlet as for example an inlet that is adapted to receive an inverted bottle of spring water. The hybrid water cooler also includes heat transfer means for transferring heat generated by the refrigeration unit to a portion of water from the water inlet to produce a mass of heated water. Conduit means such as tubing are also provided for connecting the heated water to the first water tank so that the heated water flows into the first water tank. A water tap is also provided for draining off hot water from the first water heater. In a preferred embodiment of the invention the water cooler includes an electrical heater between the first water tank and the water tap to add further heat to the heated water so that the heated water is suitable for making instant coffee, tea or etc. In addition, the water cooler in accordance with the present invention includes water cooling means and a second water tank. The water cooling means includes the refrigeration unit for cooling a portion of water from the water inlet to thereby produce a mass of cold water. Means are also provided for transferring the cold water to and into the second water tank. Second tap means are provided for draining off cold water. An important element in the present invention resides in an air cooling means that include a fan and a pump for circulating chilled water to a cooling unit and wherein the fan blows air across a series of tubes containing chilled water to provide cooled air in the surrounding space.

The invention will now be described in connection with the following drawings wherein like reference numerals have been used to identify like parts.

DESCRIPTION OF THE DRAWINGS

FIG. 3 is schematic illustration of a hybrid apparatus in accordance with a preferred embodiment of the invention.

DESCRIPTION OF THE PREFERRED EMBODIMENTS OF THE INVENTION

Figure 2:
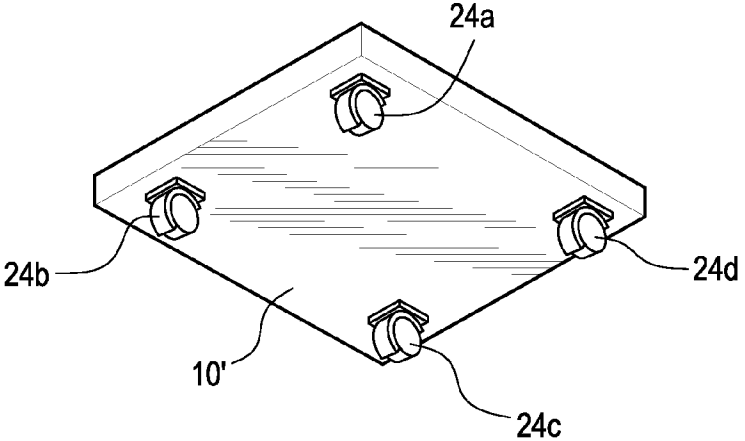
FIG. 2 is a perspective view of a base and casters of the type used in a preferred embodiment of the invention.
Figure 1:
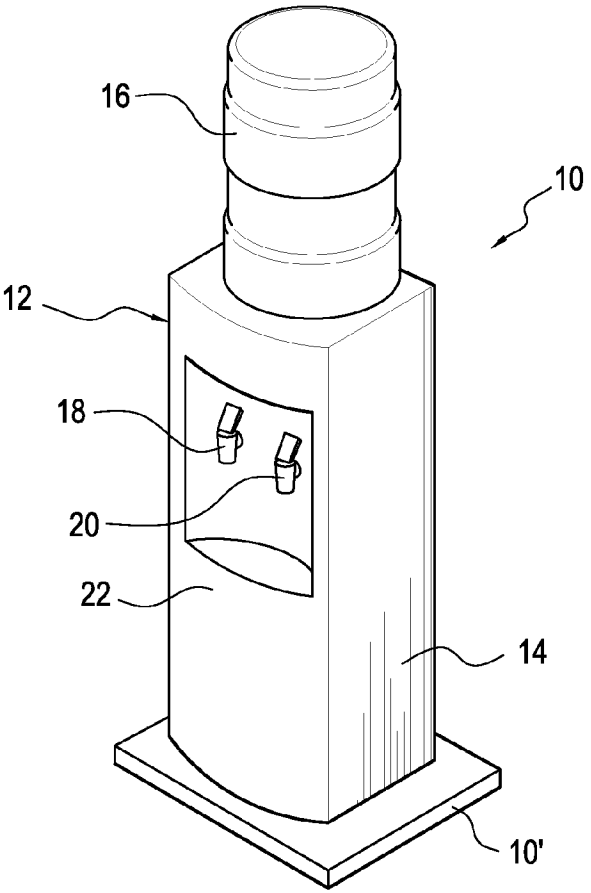
Figure 1 Prior Art
FIG. 1 is a perspective view of a conventional water cooler.
Figure 4:
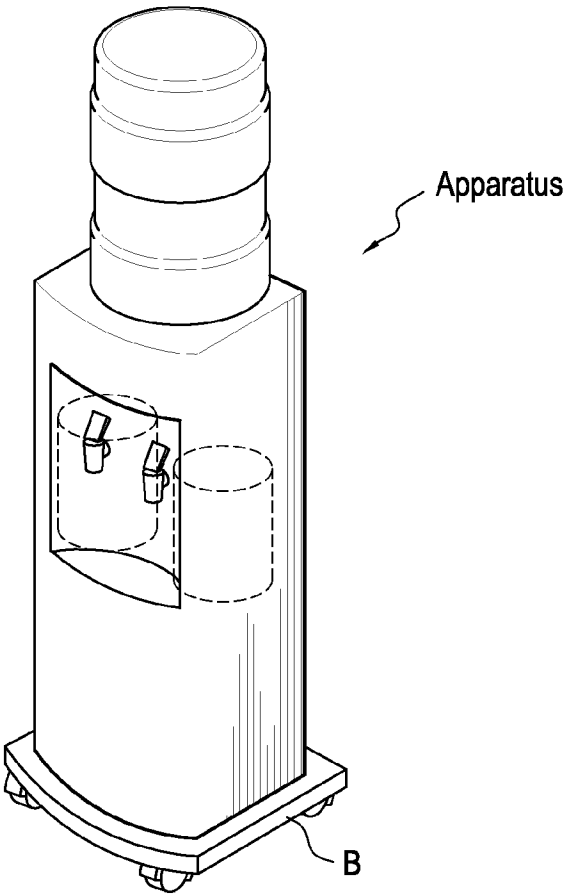
FIG. 4 is a schematic illustration of a hybrid apparatus in accordance with a preferred embodiment of the invention.

Referring now to FIG. 1, a water cooler 10 includes a cabinet 12, a base 14 and a bottle 16 mounted on the top of the cabinet 12 in an inverted position. As shown, the bottle 16 is typically a five gallon bottle. The base 14 contains an electrical refrigeration system (not shown in FIG. 1) and faucets 18 and 20 located in the front face 22 of the cooler 10.

Water coolers as well as the hybrid apparatus in accordance with the present invention are some what portable. For example, the apparatus for cooling and heating water are designed to be moved from one area to another and include a set of caster 24*a, b, c*, and d on the base 10. They are designed to move from one room to another and to be plugged into an electrical socket and therefore employ casters that allow the cooler with a five gallon water bottle filled with water to be readily moved.

As illustrated in FIG. 3, a hybrid apparatus for cooling and heating water 30 in accordance with the present invention is designed to cool water and air while heating water and storing hot water for future use. The apparatus 30 includes a first water tank wherein the contents are subject to temperature control by a refrigeration system. As shown, hot and cold water can be obtained from the dispenser faucets or spigots 31 and 33 by depressing the appropriate one of the spigots which typically projects outwardly from a first panel (not shown). The spigots 31 and 33 will normally project outwardly from a recessed portion of the front panel to prevent inadvertent contact.

As illustrated in FIG. 3, the hybrid apparatus for cooling and heating water of the present invention includes a refrigeration system designated generally as 35 comprising conventional components such as a compressor, condenser and evaporator coils, a thermostat, relay and electrical cables are also of conventional design and not shown in the drawings. The compressor 43 is powered by electricity received through a cord 50 from an external electrical power socket 51. The compressor 43 compresses and circulates a refrigerant such as HCFC to a condenser unit 44. The condenser unit condenses the hot gas received from the compressor 43 and the condensed refrigerant is then circulated to an evaporator 35 wherein the refrigerant evaporates cooling the adjacent service of the first water tank 41. From the evaporator the refrigerant is returned by way of a cooling coil 42 that passes around a water tank 41 to the compressor 43 by a compressor supply line 53.

Water from a water source 56 or bottle of spring water is delivered to a heat recovery unit 60 adjacent to the condenser 44 and from the heat recovery unit 60 to an insulated hot water tank 62 and from the water tank 62 to a hot water tap 64. Water from water source 56 is also supplied to a cold water circuit 65 for delivery through a filter 48 to a cold water tap 67 which is cooled by the refrigerant in the refrigerant coil 42 before the refrigerant is passed on to the compressor 43.

The refrigerated or cold water from water tank 41 is pumped by a water pump 75 to a fan-coil unit 47 which includes an electrically driven fan 68 and a coil of copper tubing. The water passes through a suitable conduit 71 through a filter 48 and back to the water tank 41. Refrigerated water can be drawn out of the water tank 41 by the faucet or spigot 49.

In a preferred embodiment of the invention a temperature indicator 70 indicates the temperature of the water in the hot water tank 62 and a second water pump 72 circulates the water from the tank 62 back to the heat recovery unit 60 to maintain an elevated water temperature in the tank 62. In addition, an electrical heater 74 is disposed near the hot water tap 64 to provide hotter water that is suitable for making instant coffee, instant soup or the like.

For efficiency, chilled water from the cold water tank 41 is pumped by a pump 75 through conduits 76 to a cooling unit 47 which is in the form of a coil of copper tubing or the like. The electrically powered fan 68 then blows air across the cooling unit 47 to exhaust cooling air out and into the surrounding area.

While the invention has been described in connection with the accompanying drawings it should be recognized that changes and modifications may be made therein without departing from the scope of the appended claim.

What is claimed is:

1. A hybrid apparatus for cooling and heating water and air and storing heated water, said apparatus comprising:

a refrigeration system, a first insulated water tank, a water inlet, a heater and a pump for transferring heat from said refrigeration system into a portion of the water from said water inlet to thereby produce heated water, a first pipe for delivering heated water from said heater into said first water tank and a first tap for drawing off heated water;

a water cooling mechanism including said refrigeration system for cooling a portion of water from said water inlet to thereby produce a mass of cooled water, a second water tank and a second pipe for transferring the cooled water to said second water tank and a second tap for draining off cooled water;

an air cooling mechanism including said refrigeration system for cooling air to thereby produce cooled air and a fan directing the cooled air into a surrounding area;

an outer housing and a set of casters for moving said hybrid apparatus from one room to another to thereby provide a portable apparatus; and in which said air cooling mechanism includes a cooling coil disposed around said second water tank, a pump for pumping cold water into said cooling coil and said fan blows air across said coil; and an electrical heater near said first tank adding additional heat to the heated water.

2. A hybrid apparatus for cooling water and air while heating water and storing heated water, said apparatus comprising:

a mass of liquid and gaseous refrigerant and a compressor for raising the temperature and pressure of the gaseous refrigerant, an evaporator in which the liquid refrigerant boils at low temperature to produce cooling and a condenser in which the gaseous refrigerant discharges its heat and an expansion valve through which the liquid refrigerant expands from a high pressure level in said condenser to the low pressure level in said evaporator;

a water inlet for receiving a mass of water, a first insulated tank and a heater and a pump for transferring heat from said evaporator to the mass of water and a first insulated tank for receiving water from said heater and pump and storing heated water;

a tap for obtaining heated water from said insulated tank;

a second water tank and means including said evaporator for cooling a portion of said water from said water inlet;

a pipe for transferring a portion of said water from said water inlet;

a second pipe for transferring said cooled water from said evaporator and into said second water tank, and a second tap for removing cooled water from said second water tank;

a fan for cooling the air and circulating cooled air into an enclosed space;

an outer housing and a set of casters for moving said apparatus from one area to another:

a cooling coil around said second water tank;

an electrical heater between said water inlet and said first tap for adding additional heat to the heated water; and a second cooling coil displaced from said second water tank and adjacent said fan and said pump for pumping chilled water into said coil for cooling air displaced by said fan.

3. A portable hybrid apparatus for cooling and heating water and for cooling the air in an enclosed space surrounding said apparatus, said apparatus comprising:

a wheeled housing and an electrical adapter adapted to be plugged into an electrical socket;

a refrigeration system connected to a wall socket, a water inlet and heater and a pump for transferring heat from said refrigeration system into a portion of the water from said water inlet and a first tap for drawing off heated water;

said refrigeration system cooling a portion of water from said water inlet to produce a mass of cold water, a water tank and a cooling coil surrounding said water tank and a first pipe for transferring cold water to said water tank and a second pipe for drawing cold water out of said water tank; and said refrigeration system cooling air and a fan for circulating cold air from said housing into a confined space; and an electrical heater between said heat transfer means and said first tap for adding additional heat to the heated water.

4. A portable hybrid apparatus for cooling and heating water and for cooling air in an enclosed space according to claim 3 which includes a second cooling coil adjacent said fan.

* * * * *